US005795252A

United States Patent [19]

Crucet

[11] Patent Number: 5,795,252

[45] Date of Patent: Aug. 18, 1998

[54] OUTFIELD WALL STRUCTURE FOR A BASEBALL PLAYING FIELD

[76] Inventor: Robert A. Crucet, 2451 Brickell Ave., Apt. 7F, Miami, Fla. 33129

[21] Appl. No.: 812,536

[22] Filed: Mar. 7, 1997

[51] Int. Cl.[6] ..... A63B 67/04

[52] U.S. Cl. ..... 473/434; 52/9

[58] Field of Search ..... 473/462, 478, 473/481, 504, 465, 434; 273/348, 389, 386, 390, 391, 392; 472/92, 94; 52/9

[56] References Cited

U.S. PATENT DOCUMENTS

| | | | |
|---|---|---|---|
| 2,066,724 | 1/1937 | Forsyth | 473/465 |
| 2,161,463 | 6/1939 | Frost | 473/465 |
| 2,174,884 | 10/1939 | Kachel | 473/465 |
| 2,333,098 | 11/1943 | Forsyth | 473/465 |
| 2,614,839 | 10/1952 | Forsyth | 473/465 |
| 2,781,149 | 2/1957 | Sistrunk | 473/465 |
| 2,812,946 | 11/1957 | Hughes | 473/465 |
| 3,001,790 | 6/1961 | Pratt | 473/434 |
| 3,872,623 | 3/1975 | Spaulding | 472/94 |
| 4,134,585 | 1/1979 | Semon | 473/434 |
| 4,239,235 | 12/1980 | Torres | 473/434 |
| 4,264,070 | 4/1981 | Torres | 473/434 |
| 4,334,681 | 6/1982 | Scheie | 473/465 |
| 5,312,109 | 5/1994 | Cagle | 472/92 |

*Primary Examiner*—Theatrice Brown
*Attorney, Agent, or Firm*—Robert M. Downey, P.A.

[57] ABSTRACT

An outfield wall assembly for installation above a ground surface about at least a portion of the perimeter of the outfield of a baseball playing field includes a wall structure having two or more panels, each having a main front face, the panels being positioned and disposed so that the main front faces of each of the panels are each positioned and disposed in angled relation to one another. When installed, and supported in an operative upstanding position, the main front faces of each of the panels are positioned and maintained at an upwardly and outwardly angled orientation relative to the playing field.

16 Claims, 4 Drawing Sheets

FIG. 2
PRIOR ART
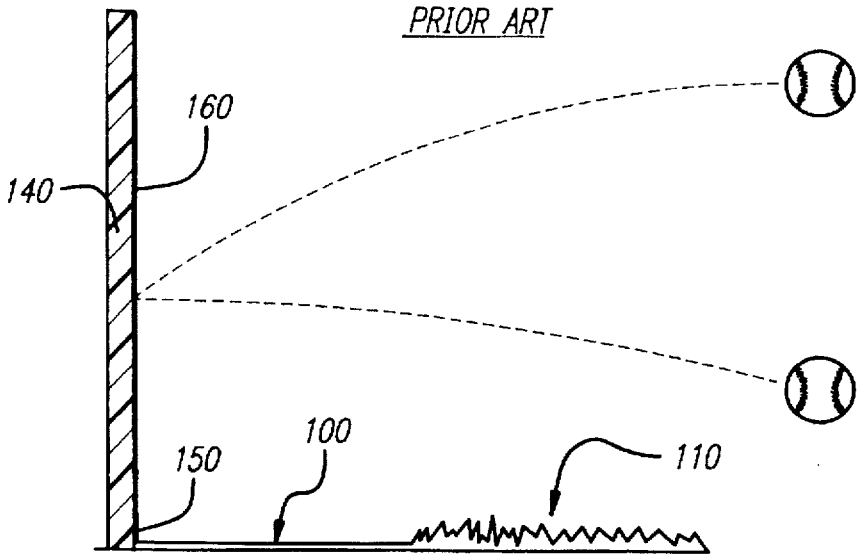
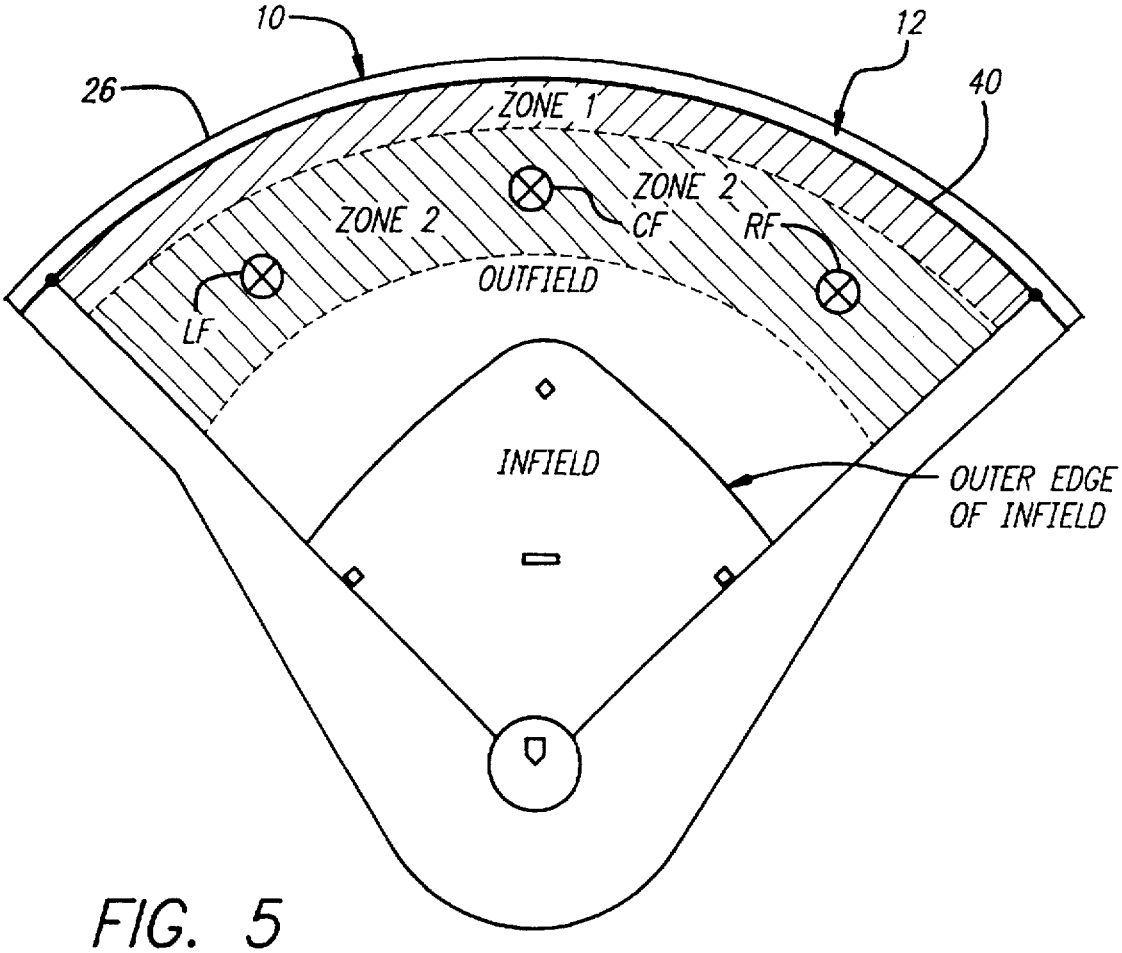
FIG. 5

OUTFIELD WALL STRUCTURE FOR A BASEBALL PLAYING FIELD

BACKGROUND OF THE INVENTION

1. Field of the Invention

The present invention relates to boundary wall structures for sports playing fields and, more particularly, to an outfield wall structure for a baseball playing field having multiple panel sections disposed at angled orientations relative to one another and the ground surface of the playing field.

2. Description of the Related Art

While the general configuration of baseball fields and the height of the outfield wall may vary from one ball park to the next, all of the outfield walls known in the art and presently in use at major league ball parks (as well as all other baseball fields) are vertical and perpendicular to the playing field. At some major league ball parks, the outfield wall height may vary at different locations about the perimeter of the outfield. Further, the face of the wall may be positioned at varying angles relative to the field of play. However, in all instances, the face of the wall remains vertical and perpendicular to the field of play, with the wall extending straight up from the base of the warning track to a top edge.

The conventional vertical outfield wall structure creates an abrupt barrier which is not only hazardous to outfielders chasing after deep fly balls, but also has the effect of limiting the base running aspect of the game. For instance, hitters occasionally hit deep line drives which fall short of a home run and strike the outfield wall. When this happens, the ball will carom off of the wall and return towards the infield. If the outfielder plays it right, he will not have to run very far from his normal position and can simply field the carom and return the ball quickly to the infield. When this happens, hitters with average base running speed are often held to a single on a ball that may have been hit as far as 400 feet. This is discouraging not only to the hitter and his team, but also the fans viewing the game.

The vertical structure of conventional outfield walls also results in many injuries to outfielders if they collide with the wall in attempting to field a long fly ball. In the past, many outfielders have dislocated shoulders, broken bones, and sustained severe bruises as a result of hard impacts with the outfield wall when running at full speed. In order to alert the fielder to the fact that they are approaching the outfield wall, while they are focused on a ball in flight, most fields have a warning track between the grass or artificial turf and the outfield wall. To avoid injury sustaining collisions with the outfield wall, fielders will slow down when they reach the warning track. Often, this results in the outfielder missing a fly ball which lands in the warning track or strikes the wall.

Accordingly, there exists a need in the game of baseball, and particularly professional baseball, for an outfield wall assembly which will reduce the degree of carom of balls striking the wall, thereby enhancing the base running aspect of the game, the fielding aspect of the game, and the viewing excitement and enjoyment of the game. Further, there is a need to provide an outfield wall structure which will substantially reduce the number of injuries sustained by outfielders, thereby allowing star players to participate in more games during the season while also extending their career.

SUMMARY OF THE INVENTION

An outfield wall assembly for installation above a ground surface about at least a portion of the perimeter of the outfield of a baseball playing field includes a wall structure having two or more panels, each having a main front face, the panels being positioned and disposed so that the main front faces of each of the panels are each positioned and disposed in angled relation to one another. When installed, and supported in an operative upstanding position, the main front faces of each of the panels are positioned and maintained at an upwardly and outwardly angled orientation relative to the playing field.

OBJECTS AND ADVANTAGES OF THE INVENTION

With the foregoing in mind, it is a primary object of the present invention to provide an outfield wall assembly which is structured and disposed to enhance the overall quality and enjoyment of a baseball game, and particularly a professional baseball game played in a stadium.

It is, more particularly, a primary object of the present invention to provide an outfield wall assembly which is structured to enhance the base running aspects, fielding aspects, and viewing enjoyment of a baseball game played before a crowd of spectators (fans).

It is a further object of the present invention to provide an outfield wall assembly the structure of which will reduce the severity and number of injuries which occur during the course of a baseball season.

It is, more specifically, an object of the present invention to provide an outfield wall assembly which is structured to reduce the likelihood of dislocated shoulders, broken bones, bruises, and other injuries which are caused as the result of baseball players striking the outfield wall while running to field a ball.

It is a further object of the present invention to provide an outfield wall assembly which is structured to reduce the amount of carom of a baseball striking the wall, thereby requiring a fielder to run greater distances to field balls that are hit to the outfield wall.

It is a further object of the present invention to provide an outfield wall assembly, as set forth above, wherein fielders are required to run further after baseballs that are hit to the outfield wall, thereby allowing base runners more time to run the bases, resulting in added action and excitement for players and spectators.

It is a further object of the present invention to provide an outfield wall assembly which is structured to substantially reduce the number of ground rule doubles which occur in a baseball game.

It is still a further object of the present invention to provide an outfield wall assembly, as set forth above, which, by the nature of its structure, will increase the number of extra base hits, including in the park home runs, that occur during the course of a baseball game.

It is still a further object of the present invention to provide an outfield wall assembly which is structured to allow a fielder to scale the outfield wall to field a ball, either on a bounce or on the fly.

It is still a further object of the present invention to provide an outfield wall assembly which is structured to increase the field of play by allowing fielders to run through a ball that has been hit to the outfield wall, by running and scaling the wall or diving towards the wall, rather than slowing down when reaching the warning track in front of the outfield wall.

These and other objects and advantages of the present invention will be more readily apparent in the detailed description which follows when taken in conjunction with the accompanying drawings.

BRIEF DESCRIPTION OF THE DRAWINGS

For a fuller understanding of the nature of the present invention, reference should be had to the following detailed description taken in conjunction with the accompanying drawings in which:

FIG. 2 is a side elevational view, in partial section, illustrating the operative position of a conventional outfield wall relative to the ground surface of a baseball playing field, as well known in the prior art, wherein the degree of rebound or carom of a baseball striking the face of the wall is shown;

FIG. 5 is a top plan view of a baseball playing field;

Like reference numerals refer to like parts throughout the several views of the drawings.

DETAILED DESCRIPTION OF THE PREFERRED EMBODIMENTS

Figure 1:
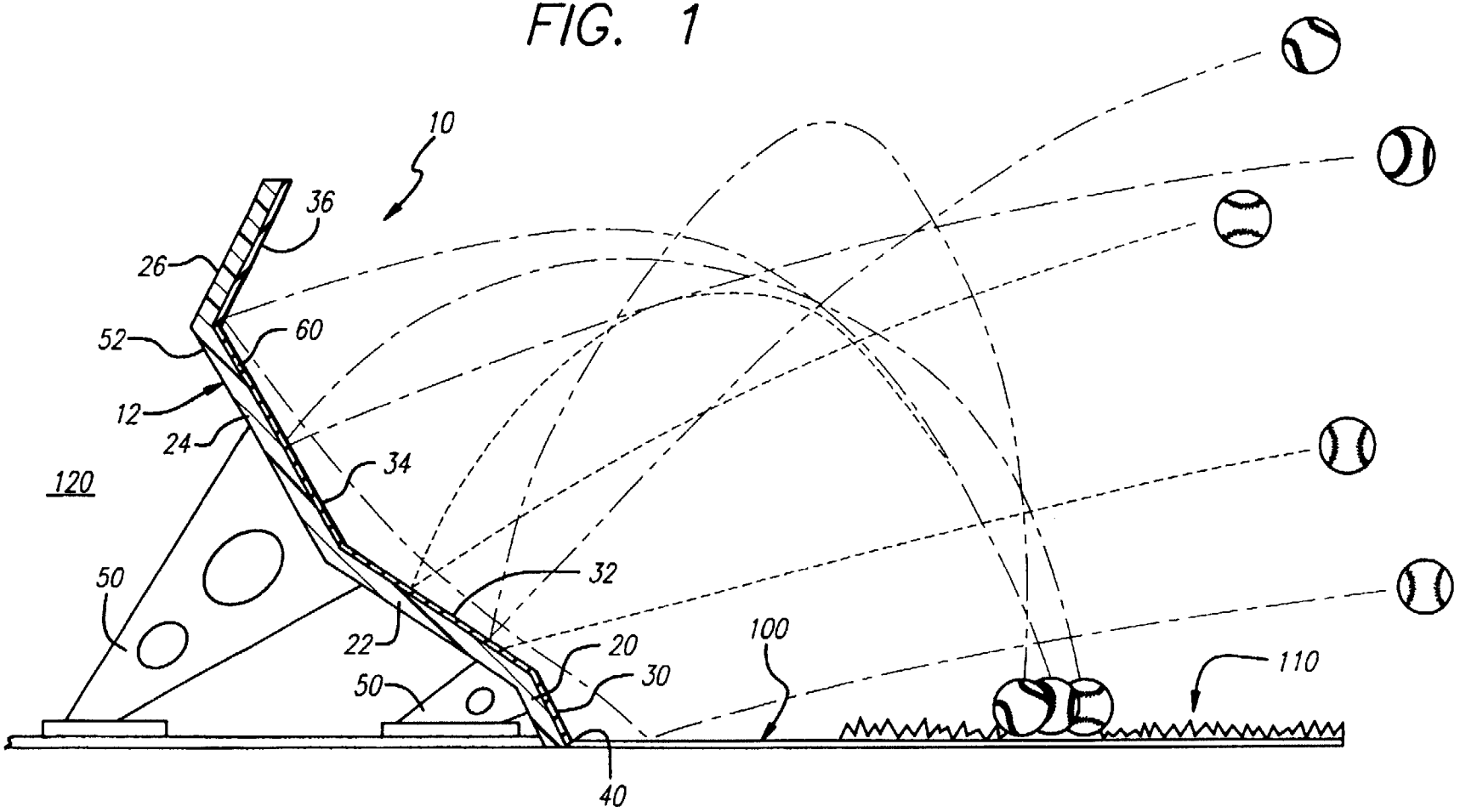
FIG. 1 is a side elevational view, in partial section, illustrating one preferred embodiment of the outfield wall assembly of the present invention shown in an installed, operative position on a ground surface at the perimeter of the outfield of a baseball playing field, wherein the degree of rebound or carom of baseballs striking various areas of the wall structure is shown.

Referring initially to FIG. 1, the outfield wall assembly of the present invention is shown in accordance with one preferred embodiment thereof, and is generally indicated as 10. The outfield wall assembly 10 includes a wall structure 12 which is intended to be supported in upstanding position relative to the ground surface 100 of a baseball playing field 110.

The wall structure 12 includes a plurality of panels. In the embodiment in FIG. 1, the wall structure 12 includes four panels including a base panel 20, a top panel 26, and intermediate panels 22, 24. The panels 20, 22, 24 and 26 each include a main front face 30, 32, 34, 36, respectively. The front faces 30, 32, 34, 36 are disposed in angled relation relative to one another so that when the wall structure 12 is supported in an upstanding, operative position (as seen in FIG. 1), the front faces 30, 32, 34, 36 of each of the panels are angled generally upwardly and outwardly relative to the ground surface 100 and the field of play 110.

The lowermost base panel 20 has its bottom edge 40 disposed in engaging relation with the ground surface 100 so that a baseball rolling along the ground surface 100 will strike the front face 30 of the base panel 20 and roll upwardly along the sloped front face 30, and possibly on to the intermediate panels, 22, 24. Eventually, gravity will cause the baseball to roll back down the panels of the wall structure 12 to the ground surface 100, unless a player fields the ball while it is still on the wall 12.

In accordance with the present invention, the panels 20, 22, 24 and 26 of the wall structure 12 may be made of any suitable material which is strong enough to support the force of one or more persons landing on one or more of the panels. It is contemplated that the panels of the wall structure 12 may be formed of wood (such as plywood), fiberglass, cement, or a transparent polycarbonate material (or like material) such as that used for basketball back boards and the upper transparent sections around a skating rink. Further, the panels 20, 22, 24 and 26 may all be made of the same material or, alternatively, varying materials may be used for different panels. For instance, the base panel 20 and intermediate panel 22 may be made of wood or fiberglass while the intermediate panel 24 and/or top panel 26 may be made of a transparent polycarbonate safety glass, to permit viewing of the playing field from an area 120 behind the wall structure 12.

Figure 3:
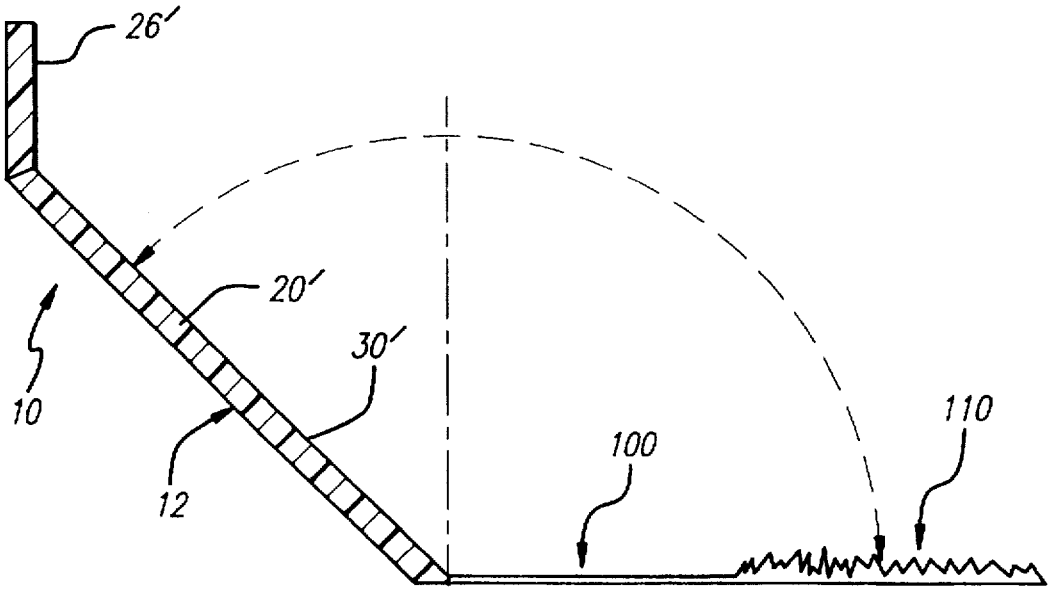
FIG. 3 is a side elevational view, in section, illustrating another embodiment of the outfield wall assembly of the present invention.
Figure 4:
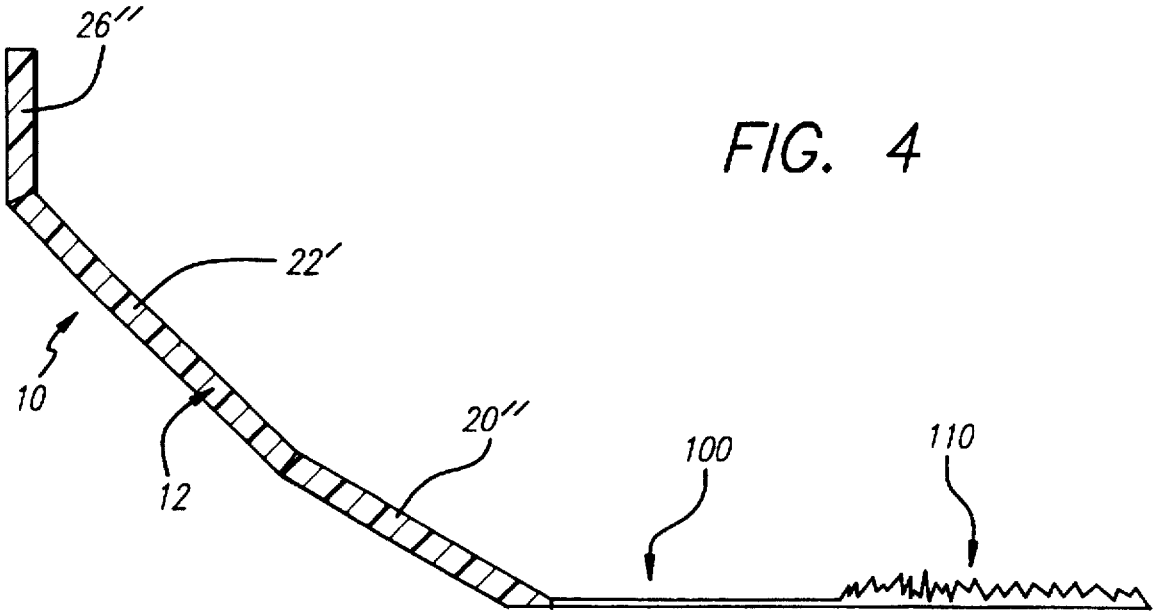
FIG. 4 is a side elevational view, in section, illustrating yet another embodiment of the outfield wall assembly of the present invention.

Naturally, the wall structure 12 needs to be supported in the upstanding, operative position, as seen in FIGS. 1, 3 and 4. Within the spirit and scope of the present invention, it is contemplated that the wall structure 12 may be supported in the upstanding, operative position by various means of support. The particular means of support may depend upon the structure of the baseball stadium, including any structure in the area 120. For instance, if there are bleachers or stands behind the wall structure 12, adjacent upper wall panel 26, then it may be desirous to mount the wall structure 12 to the stadium structure using brackets and other suitable securing means. FIG. 1 illustrates one particular example wherein the area 120 is unobstructed. In this instance, support braces 50 may be installed to a rear side 52 of the wall 12 to support the panels in a manner which provides the optimal load bearing results. Support braces 50 of this nature may anchor to the ground surface 100, behind the wall 12, or to structure of the stadium such as cement walls.

One or more of the panels 20, 22, 24, and/or 26 may be provided with a resilient material 60, such as a rubber composition, having an exterior surface defining the main front faces 30, 32, 34 and/or 36 of the respective panels. The resilient material softens the impact of a baseball striking the main faces of the panels, to reduce the velocity of the baseball when bounces off of the wall, thereby reducing the distance of the rebound or carom. Furthermore, the resilient material 60 helps to soften the impact when a player jumps on or dives on the wall structure 12, thereby substantially reducing the likelihood of injury. Furthermore, the exterior surface of the resilient material 60 may be of a texture which provides a grip or non-slip surface, to assist scaling of the wall 12, while reducing the likelihood of a player slipping when running up or scaling the wall 12.

The operative positioning of the front faces 30, 32, 34 and 36 in the generally upward and outward angled orientation serves to reduce or minimize the amount of rebound or carom of a baseball striking the front faces of the panels of the wall structure. FIG. 1 illustrates the carom of baseball striking various areas of the front faces 32 and 34 of the intermediate panels 22, 24. It is seen that the baseballs, after bouncing off of the wall structure 12, land and come to rest close to the base 30 of the wall 12. Referring to FIG. 5, a baseball field is shown from a top plan view for the purposes of illustrating the relative distance of carom of a baseball striking the wall 12 of the present invention, as compared to a conventional wall 140 as shown in FIG. 2. In comparison to the carom of a baseball off of the wall 12, as seen in FIG. 1, a baseball striking a conventional outfield wall 140 (see FIG. 2) will carom back towards the infield at a much greater velocity, traveling a greater distance from the base 150 of the wall 140. This is due to the abrupt angle of impact of the ball against the surface 160 of the conventional wall 140 due to the vertical orientation of the wall surface 160 at an angle of 90° relative to the ground surface 100.

Referring to FIG. 5, to compare the degree of carom between the wall 12 of the present invention and a conventional outfield wall 140 (FIG. 2), the outfield has been divided into two zones, including zone 1 which is closer to the outfield wall and zone 2 which extends further away from the outfield wall to shallow outfield and closer to the infield. Zone 1 and zone 2 are shaded in contrast and their boundaries are indicated by the dotted lines. The first dotted line 70 separating zone 1 and zone 2 is no more than 50 feet away from the base 40 of the wall 12 of the outfield wall 12. The innermost perimeter of zone 2, indicated by dotted line 72, is much further away from the base of the wall 40 and, for purposes of illustration, is approximately 150 feet away from the base of the wall 40. Outfielders, including rightfielder RF, leftfielder LF, and centerfielder CF, are shown at standard depths in accordance with fundamental positioning in the outfield. To illustrate the difference in the degree of carom, most balls striking the wall structure 12 of the present invention will carom off of the wall 12 and land within zone 1. Accordingly, outfielders RF, CF, and LF are required to run from their normal position towards the wall 12 to retrieve the ball in zone 1. In contrast, a fly ball striking a conventional wall 140 will normally carom into zone 2. If the point of impact of the ball against the wall happens to be directly behind any of the fielders RF, CF or LF, they simply turn around and field the ball without having to run any great distance. They are then able to relay the ball quickly to the infield, holding the base runner to a single or double. On the other hand, a fly ball landing in zone 1 after caroming off of the wall 12 of the present invention, will require the outfielders RF, CF and LF to run a much greater distance, thereby enabling the base runner to run for a greater length of time to achieve a double, triple or possibly an in the park home run.

Referring to FIGS. 3 and 4, alternative embodiments of the outfield wall structure 12 are shown. In FIG. 3, the outfield wall structure 12 includes a first panel 20' which slopes upwardly and outwardly relative to the field of play 110. A substantially vertical wall section 26' may be provided at the top for placing distance markers and to prevent a baseball rolling up the wall 20' from traveling over the top.

In FIG. 4, the wall 12 includes a first base panel 20", an intermediate panel 22', and a top panel 26". In each of the embodiments shown in FIGS. 1, 3 and 4, the front faces of each of the panels are disposed in angled orientation relative to one another as well as the playing field 110. Further, in each of the embodiments, at least one of the front faces of the wall panels of the wall structure is positioned at an angle greater than 90° from the ground surface 100 measured through an arc from the ground surface on the playing field 110 to the main front face of the respective panel. For instance, the front face 30' of the panel 20' in FIG. 3 is shown at an angle of 140° relative to the ground surface 100 on the playing field 110.

Figure 6:
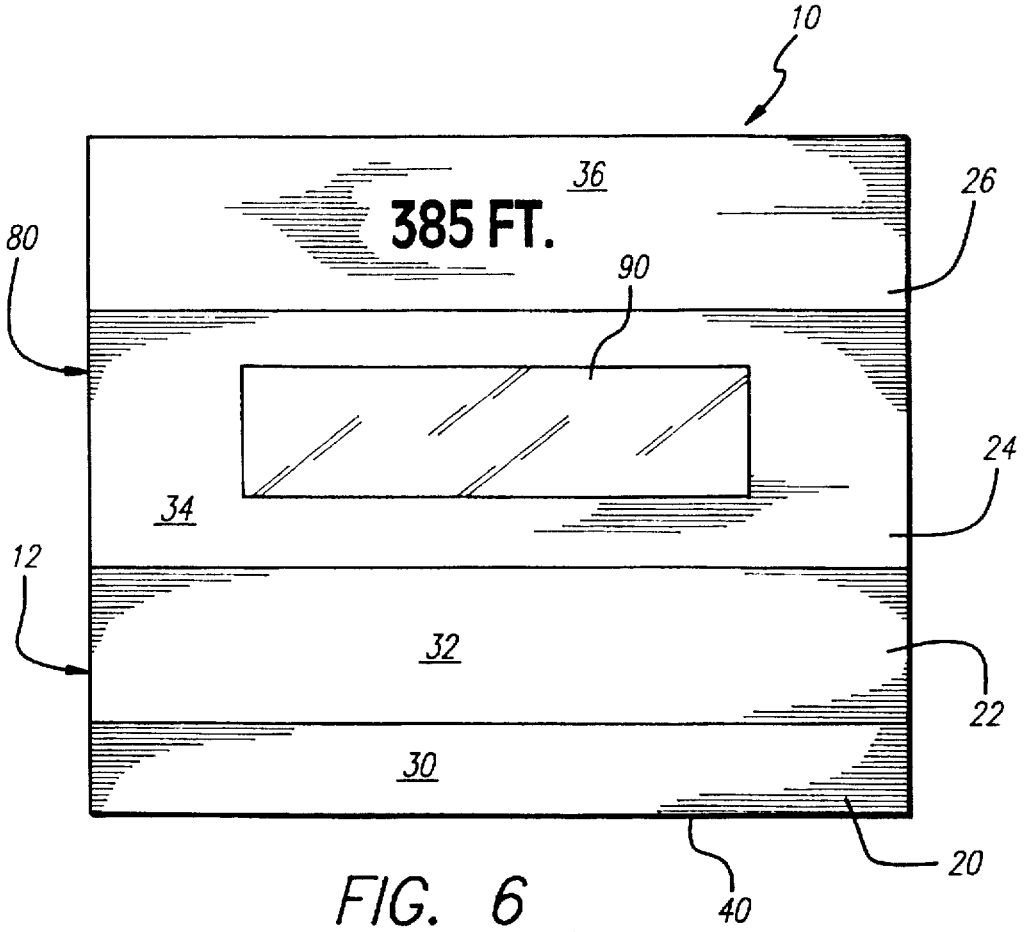
FIG. 6 is a front elevational view, of a main front face of the outfield wall assembly, in accordance with one particular embodiment thereof, wherein the wall structure of the assembly includes a transparent window in one of the panels so that the playing field can be viewed by a camera or other means on an opposite side of the wall structure.
Figure 7:
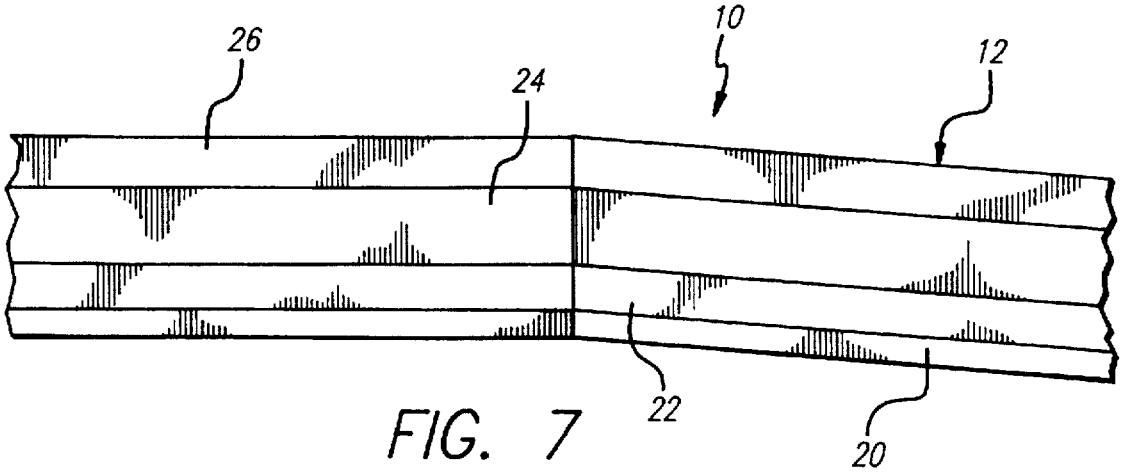
FIG. 7 is an isolated top plan view showing two sections of the wall assembly installed in operative position adjacent to one another along the perimeter of the outfield.

Referring to FIG. 6, a wall section 80 of the wall structure 12 is shown in accordance with one preferred embodiment of the present invention. In this particular embodiment, one of the panels 24 is provided with a transparent window 90, formed of a polycarbonate safety glass, to permit viewing of the playing field 110 from behind the wall 12. In this manner, a television camera or still photography camera can view the field to obtain a desired angle of photography.

While the instant invention has been shown and described in what is considered to be preferred and practical embodiments thereof, it is recognized that departures may be made within the spirit and scope of the present invention which, therefore, should not be limited excepted as set forth in the following claims and under the doctrine of equivalents.

Now that the invention has been described,

What is claimed is:

1. A baseball park comprising:

a spectator seating area and a playing field on a ground surface including an outfield having an outermost perimeter and an infield adjacent the outfield and including a plurality of bases, a pitcher's mound, a home plate, and left and right field foul lines extending from home plate, at a right angle relative to one another, to said outermost perimeter of the outfield to thereby define a fair territory of the playing field between the left and right field foul lines; and an outfield wall assembly separating said spectator seating area from said outfield and extending along at least a portion of the outermost perimeter of the outfield and including:

said wall assembly having at least two panels including a first panel having a main front face and a second panel having a main front face, said main front faces of said first and second panels being positioned and disposed in angled relation to one another so that said main front faces are not coplanar to one another; and means for supporting said wall assembly in an upstanding position relative to the playing field so that said main front faces of said first and second panels are positioned and maintained at an upwardly and outwardly angled orientation relative to the playing field.

2. An outfield wall assembly as recited in claim 1 wherein said wall assembly includes a lowermost panel defining a base panel having a main front face and a bottom edge structured and disposed for engaging the ground surface.

3. An outfield wall assembly as recited in claim 2 wherein said lowermost panel is said-first panel.

4. An outfield wall assembly as recited in claim 2 wherein said wall assembly includes at least three panels including said first panel, said second panel and said lowermost panel.

5. An outfield wall assembly as recited in claim 4 wherein said main front faces of said first panel, said second panel and said lowermost panel are disposed in angled relation relative to one another, wherein said main front faces are each disposed at a different angled orientation relative to the playing field.

6. An outfield wall assembly as recited in claim 2 wherein said wall assembly includes at least four panels, each having a main front face wherein said main front faces of said panels are all disposed in angled relation to one another and wherein said main front faces are each disposed at a different angled orientation relative to the ground surface.

7. An outfield wall assembly as recited in claim 1 wherein at least one of said panels of said wall assembly includes a resilient material having an exterior surface defining said main front face, said resilient material being structured to at least partially absorb the impact of a baseball striking said exterior surface thereof to reduce the velocity of the baseball when leaving the exterior surface on bouncing off of said at least one panel.

8. An outfield wall assembly as recited in claim 7 wherein a plurality of said panels of said wall assembly include said resilient material.

9. An outfield wall assembly as recited in claim 1 wherein at least a portion of said wall assembly is formed of wood.

10. An outfield wall assembly as recited in claim 1 wherein at least a portion of said wall assembly is formed of fiberglass.

11. An outfield wall assembly as recited in claim 1 wherein at least a portion of said wall assembly is formed of cement.

12. An outfield wall assembly as recited in claim 1 wherein at least a portion of said wall assembly is formed of polycarbonate.

13. An outfield wall assembly as recited in claim 1 wherein at least one of said panels of said wall assembly includes window means for viewing the playing field from a side of said panels opposite to said main front faces.

14. An outfield wall assembly as recited in claim 1 wherein said main front face of at least one of said panels of said wall assembly is positioned at an angle greater than 90° measured through an arc from the ground surface on the playing field to said main front face.

15. A baseball park comprising:

a spectator seating area and a playing field on a ground surface including an outfield having an outermost perimeter and an infield adjacent the outfield; and an outfield wall assembly separating said spectator seating area from said outfield and extending along at least a portion of the outermost perimeter of the outfield and including:

said wall assembly having at least two panels including a first panel having a main front face and a second panel having a main front face, said main front faces of said first and second panels being positioned and disposed in angled relation to one another so that said main front faces are not coplanar to one another; and means for supporting said wall assembly in an upstanding position relative to the playing field so that said main front faces of said first and second panels are positioned and maintained at an upwardly and outwardly angled orientation relative to the playing field.

16. A baseball park comprising:

a spectator seating area and a playing field on a ground surface including an outfield having an outermost perimeter and an infield adjacent the outfield; and an outfield wall assembly separating said spectator seating area from said outfield and extending along at least a portion of the outermost perimeter of the outfield and including:

said wall assembly having a plurality of panels including at least an uppermost first panel, an intermediate second panel, and a lowermost third panel, said plurality of panels each including a main front face, said main front faces of said plurality of panels being disposed in angled relation relative to one another so that said main front faces are not coplanar to one another; and means for supporting said wall assembly in an upstanding position relative to the playing field with said main front faces of said plurality of panels positioned and maintained at an upwardly and an upwardly angled orientation relative to the playing field so that said main front faces of said plurality of panels are each disposed at a different angled orientation relative to the playing field.

* * * * *